United States Patent [19]

Nelson et al.

[11] Patent Number: 4,753,661

[45] Date of Patent: Jun. 28, 1988

[54] FUEL CONDITIONER

[75] Inventors: Mark L. Nelson; Otis L. Nelson, Jr., both of Bay City, Mich.

[73] Assignee: Polar Molecular Corporation, Saginaw, Mich.

[21] Appl. No.: 24,821

[22] Filed: Mar. 12, 1987

Related U.S. Application Data

[63] Continuation-in-part of Ser. No. 820,687, Jan. 21, 1986, abandoned, and Ser. No. 569,161, Jan. 9, 1984, abandoned, said Ser. No. 820,687, is a continuation-in-part of Ser. No. 569,161.

[51] Int. Cl.[4] ..... C10L 1/02

[52] U.S. Cl. ..... 44/53; 44/57; 44/77; 252/351

[58] Field of Search ..... 44/53, 51, 58, 78, 54, 44/77; 252/55, 351; 585/14

[56] References Cited

U.S. PATENT DOCUMENTS

| | | | |
|---|---|---|---|
| 2,672,450 | 3/1954 | Pearsall | 44/58 |
| 2,914,479 | 11/1959 | Tom et al. | 44/77 |
| 3,250,599 | 5/1966 | Kirk et al. | 44/62 |
| 3,658,494 | 4/1972 | Dorer, Jr. | 44/77 |
| 3,917,537 | 11/1975 | Elsdon | 44/53 |
| 4,365,973 | 12/1982 | Irish | 44/57 |
| 4,378,973 | 4/1983 | Sweeney | 44/57 |

OTHER PUBLICATIONS

The Condensed Chemical Dictionary, 9th Ed., revised by Gessner G. Hawley.

Industrial Research Services, "Handbook of Material Trade Names" by O. T. Zimmerman, Ph.D. and Irvin Lavine, Ph.D., 1946.

*Primary Examiner*—William R. Dixon, Jr.

*Assistant Examiner*—Margaret B. Medley

*Attorney, Agent, or Firm*—Brumbaugh, Graves, Donohue & Raymond

[57] ABSTRACT

A fuel conditioner comprises a polar oxygenated hydrocarbon having a molecular weight from about 250 to about 500; an acid number of from about 25 to about 125, preferably from 50 to 100; and a saponification number from about 30 to about 250. The polar compound is combined with a compatibilizing agent such as an alcohol. An aromatic hydrocarbon and/or a hydrocarbon base stock may also be employed. For internal combustion engines which do not recycle exhaust to heat the fuel, a hydrophilic separant is added to cause any water present to form a separate layer. The conditioner is intended for use in internal combustion engines burning gasoline, diesel fuel, or hydrocarbon/alcohol fuels, and for boilers burning No. 2 oil and the like. Use of the fuel conditioner decreases fuel consumption, decreases engine wear, reduces carbonaceous deposits, and lowers "octane" requirements.

25 Claims, No Drawings

FUEL CONDITIONER

PREVIOUS PROSECUTION

This application is a continuation-in part of Ser. No. 569,161, filed Jan. 9, 1984 and Ser. No. 820,687 filed Jan. 21, 1986 now abandoned. Ser. No. 820,687 is a continuation-in-part of Ser. No. 569,161 now abandoned.

FIELD OF THE INVENTION

This invention relates to conditioners for hydrocarbon fuels such as gasoline, diesel fuel, heating oils, or aircraft fuels, or alcohol/hydrocarbon blends wherein a minor or major fraction of the fuel is a low molecular weight alcohol.

BACKGROUND OF THE INVENTION

Heretofore it was known to add certain polar compounds to liquid hydrocarbon fuels for various types of engines, but these attempts did not succeed in achieving the objects of this invention, found below.

Dorer disclosed in U.S. Pat. No. 3,658,494 the combination of a rather high molecular weight oxy compound and a dispersant added to the fuel for cleaning internal combustion engines. The oxygen in the compound of Dorer is in the backbone of the chain so that there is imparted no acidity nor acid number.

Tom et al. in U.S. Pat. No. 2,914,479 disclosed an upper cylinder lubricant comprising a light, aromatic lubricating oil and an oxygenated solvent such as CELLOSOLVE ®. This combination could be added either to the fuel or the carburetor. A small amount of anti-rust agent or pourpoint depressant could also be employed in the lubricant of this patent.

A penetrating oil for freeing the junction of two metal surfaces such as bolts, hinges, springs, locks, etc. comprising a lubricating oil, gasoline, an alcohol, and glycols or their ethers was disclosed in U.S. Pat. No. 3,917,537 by Elsdon. No high molecular weight components acid numbers, nor saponification numbers were specified by Elsdon, and furthermore this material was not used as a fuel conditioner.

Pearsall in U.S. Pat. No. 2,672,450 disclosed a combination of a substituted benzene, a monoalkyl glycol or glycol ether, and an ester of ricinoleic acid for removing carbonaceous deposits in internal combustion engines. This mixture was to be used as a solvent in contact with a hot, stalled engine for about one to six hours, followed by restarting the engine. Alternatively, the engine could be soaked in, sprayed or painted with this solvent mixture.

A cold flow improver for middle distillate diesel fuel comprising a vinyl acetate/ethylene copolymer, a nitroparaffin, an alcohol, and an aromatic solvent was patented in U.S. Pat. No. 4,365,973 by Irish over 17 cited references.

Sweeney disclosed in U.S. Pat. No. 4,378,973 a smoke depressant for diesel engines comprising a mixture of cyclohexane and an oxygenated compound such as aldehydes, ketones, or ethers.

It is an object of the present invention to extend the useful life of engines burning fuel incorporating the conditioner disclosed herein.

It is further object of the present invention to lower the "octane" requirement of fuels for internal combustion engines by using this conditioner in the fuel.

It is another object of the current invention to increase the efficiency of engines and thus reduce the consumption of fuels conditioned as disclosed here.

It is yet another object of this invention to condition fuel without changing significantly either its flash point or combustion temperature.

It is still another object of this invention to provide fuel which lubricates cylinder walls, cleans spark plugs, cleans carburetors and combustion chambers, helps lubricate rings, distributes fuel evenly to all cylinders, and prevents valve seat failures, especially in gasoline engines operating under high loads.

SUMMARY OF THE INVENTION

The fuel conditioner of the present invention in its simplest form comprises a polar oxygenated hydrocarbon of molecular weight from about 250 to about 500, and an oxygenated compatibilizing agent, such as an alcohol. It is often advantageous to employ also an aromatic hydrocarbon, and a mineral oil or other base stock. In some situations the fuel conditioner is more useful when a hydrophilic separating agent, such as a glycol ether, is added to separate out an aqueous layer.

This fuel conditioner is useful for internal combustion engines burning gasoline, No. 2 diesel oil or kerosene for trucks or automobiles using gasoline or diesel fuel, and for stationary engines or boilers. "High alcohol" fuel blends may also be used wherever appropriate for the engine.

The fuel conditioner of the present invention functions to decrease fuel consumption, decrease engine wear, reduce carbonaceous deposits, lower "octane" requirements, keep spark plugs and engine components clean, obviate valve failure, and distribute fuel evenly to all cylinders.

DETAILED DESCRIPTION OF THE INVENTION

The present invention is broadly applicable for the conditioning of a wide variety of hydrocarbon or modified hydrocarbon (e.g., alcohol containing) fuels for a variety of engines or furnaces burning liquid fuels.

The conditioner of the present invention most suitable for gasoline-fired internal combustion engines contains a polar oxygenated compound, a compatibilizing agent to maintain a one-phase system, an aromatic hydrocarbon (e.g., xylene), a mineral oil, and a monoether of a glycol.

Engines burning diesel fuel often have systems recirculating the hot exhaust back into the fuel to preheat it. Because this hot exhaust contains some water vapor from the oxidative combustion of hydrocarbons, it is preferable in formulating the conditioner of the present invention to omit the glycol monoether and utilize only the other four components in the conditioner for this type of engine: polar oxygenated compound, aromatic hydrocarbon, mineral or base stock oil, and compatibilizing agent (e.g., a hexanol).

Heating furnaces require simple hydrocarbon fuel oils known in commerce as No. 1, No. 2, No. 3, etc., up to No. 6 oil. For these petroleum fractions, the mineral oil constituent of the conditioner is not required, leading to a tripartite composition of polar oxygenated compound, compatibilizer, and aromatic constituent to help cleanliness and efficiency of combustion.

For an alcohol-modified hydrocarbon fuel often employed in internal combustion engines (e.g., "gasohol") with a wide range of hydrocarbon/alcohol ratios, it has been found that a mineral oil component mitigates against maintaining a one-phase system, hence, the preferred formulation for use in alcohol-containing fuels is the polar oxygenated compound, an aromatic compound, and a compatibilizing agent such as a higher alcohol.

Fuels of this type may range from a hydrocarbon/alcohol ratio of about 95/5 wgt. % to an alcohol-rich 10/90 wgt. %. Methanol, ethanol, and 2-propanol are amongst the low molecular weight alcohols which may be used. A typical fuel conditioner for this type of fuel comprises about 30 wgt. % polar oxygenated hydrocarbon, about 30 wgt. % xylene, and about 40 wgt. % decanol. This type of conditioner of the present invention may be employed at a level of from about 1 part per 2000 to about 1 part per 400. A monoether of a glycol is not required, since any water present will dissolve in the alcohol of the fuel.

For the lighter fuels useful for aircraft engines, it has been found preferable to omit both the aromatic compound and the mineral oil, hence, the conditioner for this use has for best results the three oxygenated components: polar oxygenated compound, glycol monoether, and compatibilizing agent.

In all the formulations of the present invention, both above and below, the word "compound" or "component" can mean a mixture of the various possible individual compounds or components which are members of that class. For example, the word "xylene" as a preferred member of the class of aromatic compounds not only means o-xylene, m-xylene, or p-xylene, but also means aromatic "cuts" or distillates of aromatic hydrocarbons containing not only xylene but benzene, toluene, durene and naphthalene which may be mixed in with the "xylene."

The polar oxygenated hydrocarbon of the present invention signifies various organic mixtures arising from the controlled oxidation of petroleum liquids with air. Often these air oxidations of liquid distillates are carried out at a temperature of from about 100° C. to about 150° C. with an organo-metallic catalyst, such as esters of manganese, copper, iron, cobalt, nickel or tin, or organic catalysts, such as tertiary butyl peroxide. The result is a melange of polar oxygenated compounds which may be divided into at least three categories: volatile, saponifiable and nonsaponifiable.

The polar oxygenated compounds preferable for use in the present invention may be characterized in a least three ways, by molecular weight, acid number, and saponification number. Chemically these oxidation products are mixtures of acids, hydroxy acids, lactones, esters, ketones, alcohols, anhydrides, and other oxygenated organic compounds. Those suitable for the present invention are compounds and mixtures with an average molecular weight between about 250 and 500, with an acid number between about 25 and about 125 (ASTM-D-974), and a saponification number from about 30 to about 250 (ASTM-D-974-52). Preferably the polar oxygenated compounds of the present invention have an acid number from about 50 to about 100 and a saponification number from about 75 to about 200. An example of a polar oxygenated hydrocarbon within this preferred range is Alox 400L (Alox Corporation, Niagara Falls, N.Y.).

Suitable compatibilizing agents of the instant invention are organic compounds of moderate solubility parameter and moderate to strong hydrogen-bonding capacity. Solubility parameters, $\delta$, based on cohesive energy density are a fundamental descriptor of an organic solvent giving a measure of its polarity. Simple aliphatic molecules of low polarity have a low $\delta$ of about 7.3; highly polar water has a high $\delta$ of 23.4. Solubility parameters, however, are just a first approximation to the plarity of an organic solvent. Also important to generalized polarity, and hence solvent power, are dipole moment and hydrogen-bonding capacity. Symmetrical carbon tetrachloride and some aromatics with low gross dipole moment and poor hydrogen-bonding capacity have a solubility parameter of about 8.5. In contrast, methyl propyl ketone has almost the same solubility parameter, 8.7, but quite strong hydrogen-bonding capacity and a definite dipole moment. Thus, no one figure of merit describes the "polarity" of an organic solvent.

For the practice of the present invention a compatibilizing agent should have a solubility parameter from about 8.8 to about 11.5 and moderate to strong hydrogen-bonding capacity. Suitable classes of organic solvents are alcohols, ketones, esters, and ethers. Preferred compatibilizing agents are straight-chain, branched-chain, and alicyclic alcohols with from six to 14 carbon atoms. Especially preferred compounds for compatibilizing agents are the hexanols, the heptanols, the ectanols, the decanols, and the dodecanols.

The conditioner of the present invention prevents large amounts of water from being incorporated into large quantities of fuel being stored by including a separating or so-called "precipitating" agent, which decreases the amount of water in the hydrocarbon fuel, thus improving combustion. Suitable separating agents for practicing the current invention are ethers of glcyols or polyglycols, especially monoethers. Monoethers are preferred over diethers in the practice of the present invention.

Examples of such compounds which may be used are the monoethers of ethylene glycol, propylene glycol, trimethylene glycol, alphabutylene glycol, 1,3-butanediol, betabutylene glycol, isobutylene glycol, tetramethylene glycol, hexylene glycol, diethylene glycol, dipropylene glycol, tripropylene glycol, triethylene glycol, tetraethylene glycol, 1,5-pentanediol, 2-methyl-2-ethyl-1,3-propanediol, 2-ethyl-1,3-hexanediol. Some monoethers include ethylene glycol monophenyl ether, ethylene glycol monomethylether, ethylene glycol monoethyl ether, ethylene glycol mono-(n-butyl) ether, diethylene glycol monomethyl ether, diethylene glycol monoethyl ether, diethylene glycol mono-(n-butyl) ether, propylene glycol monomethyl ether, dipropylene glycol monomethyl ether, diethylene glycol monocyclohexylether, ethylene glycol monobenzyl ether, triethylene glycol monophenethyl ether, butylene glycol mono-(p-(n-butoxy) phenyl) ether, trimethylene glycol mono(alkylphenyl) ether, tripropylene glycol monomethyl ether, ethylene glycol monoisopropyl ether, ethylene glyxol monoisobutyl ether, ethylene glycol monohexyl ether, triethylene glycol monobutyl ether, triethylene glycol mnonomethyl ether, triethylene glycol monoethyl ether, 1-butoxyethoxy-2-propanol, monophenyl ether of polypropylene glycol having an average molecular weight of about 975 to 1075, and monophenyl ether of polypropylene glycol wherein the polyglycol has a average molecular weight of about 400 to 450, monophenyl ether of polypropylene glycol wherein the polypropylene glycol has an average molecular weight of 975 to 1075. Such compounds are sold commercially under trade names such as Butyl CEL- LOSOLVE, Ethyl CELLOSOLVE, Hexyl CELLOSOLVE, Methyl CARBITOL, Butyl CARBITOL, DOWANOL Glycol ethers, and the like.

It should be repeated that this separating or "precipitating" agent should not be employed in diesel fuel systems wherein the hot unburned fuel is recirculated back to the fuel tank to preheat the fuel, because such fuel contains excessive amounts of water vapor which should not build up in the fuel system.

In the practice of the current invention, it has been found useful to include an aromatic hydrocarbon, or a mixture of such, as a component of the fuel conditioner of the present invention. Any aromatic hydrocarbon blend that is liquid at room temperature is suitable. Among these are benzene, toluene, the three xylenes, trimethylbenzene, durene, ethylbenzene, cumene, biphenyl, dibenzyl and the like or their mixtures. The preferred aromatic constituent is a commercial mixture of the three xylenes, because it is cheaper than any pure xylene. Aromatic naphthas are also useful. Without being limited to any theory or hypotheses for the use of an aromatic hydrocarbon, it has been found that the presence of an aromatic hydrocarbon in the conditioner promotes clean and efficient combustion of the fuel.

A light mineral oil or base stock is advantageously used when the fuel conditioner is applied to fuels for gasoline and diesel internal combustion engines. By "light" mineral oil is meant those petroleum, aliphatic, or alicyclic fractions having a viscosity less than 10,000 SUS at 25° C. A mixture of hydrocarbon fractions may also be employed in place of a base stock.

Given the presence of the several constituents described above, a wide range of proportions are suitable for the practice of the instant invention. Below a Useful Range and a Preferred Range are given in weight percent:

| Component | Weight Percent | |
|---|---|---|
| | Useful Range | Preferred Range |
| Polar oxygenated compound | 10–80 | 20–40 |
| Compatibilizing agent (esp. alcohol) | 5–50 | 10–40 |
| Separating agent (esp. glycol monoether) | 5–75 | 10–50 |
| Aromatic hydrocarbon (esp. xylene) | 10–50 | 20–40 |

-continued

| Component | Weight Percent | |
|---|---|---|
| | Useful Range | Preferred Range |
| Mineral oil | 5–40 | 10–20 |

For the particular fuels wherein the conditioner of the present invention is useful such as gasoline engines, diesel engines, engines burning "gasohol", aircraft engines, and heating furnaces, the proportions employed will vary for maximum efficiency of combustion. The amount of conditioner of the present invention employed can usefully range from about 1 part per 500 parts fuel to about 1 part per 2000 parts fuel and can be effective at even lower concentrations. The preferred range is from about 1 part per 800 parts fuel to about 1 part per 1200 parts fuel.

Having described the present invention above, it is now illustrated in the following Examples. These Examples, however, do not limit the application of the present invention which may be carried out by other means in other systems. The scope of this disclosure is described more fully in the claims.

EXAMPLE 1

This Example illustrates the benefits of employing one part per thousand of the fuel conditioner of the present invention in a fleet of 626 varied vehicles over a period of 2.5 years.

A fuel conditioner consisting of 30 wgt. % polar oxygenated hydrocarbon (Alox 400L), 25 wgt. % xylene, 15 wgt. % hexanol (EPAL 6, Ethyl Corp., Baton Rouge, LA), 15 wgt. % mineral oil (1,000 SUS at 77%F), and 15 wgt. % diethylene glycol monomethylether was made up and termed FC-I.

Another fuel conditioner was made up consisting of 30 wgt. % polar oxygenated hydrocarbon (Alox 400L), 25 wgt. % xylene, 20 wgt. hexanol (EPAL 6), and 25 wgt. % mineral oil. This was termed FC-II. No glycol ether was employed because the diesel trucks using FC-II have an exhaust recirculating system.

The conditioners were tested in a fleet of vehicles employing FC-I or FC-II as shown in Table I.

TABLE I

| NUMBER | VEHICLE | TYPE | REGULAR FUEL | TEST FUEL USED(1 ppt) |
|---|---|---|---|---|
| 243 | Cars & Vans | Less than 5,000 lbs. | No-Lead | No-Lead & FC-I |
| 51 | Trucks | 12,000–15,000 lbs. | Leaded Gas | No-Lead & FC-I |
| 52 | Trucks | 12,000–15,000 lbs. | Diesel | Diesel & FC-II |
| 84 | Trucks | 12,000–32,000 lbs. | Leaded Gas | No-Lead & FC-I |
| 44 | Trucks | 12,000–32,000 lbs. | Diesel | Diesel & FC-II |
| 14 | Trenchers & Compressors | | Leaded Gas | No-Lead & FC-I |
| 26 | Trenchers & Compressors | | Leaded Gas | No-Lead & FC-I |
| 72 | Trucks | Maximum 7,000 lbs. | No Lead | No-Lead & FC-I |
| 70 | Trucks | Maximum 7,000 lbs. | Leaded gas | No-Lead & FC-I |
| 626 | | | | |

The fuel conditioner was added to the underground fuel storage tanks to make sure all the vehicles participated in the test.

After 2½ years it was found that there was an average fuel saving of 5.0% for all the vehicles; and 7.0% for those vehicles using FC-I. Additionally, there were no upper cylinder failures and no valve-seat failures. Before this test, upper cylinder and valve-seat failures were common on the heavy-duty vehicles. After 3½ years of total test time, similar savings in fuel and reduction of engine wear are still being observed.

After the first six months of the test, no leaded gasoline was used, even in the large trucks said to require leaded gasoline.

This test shows that the fuel conditioner of the present invention can lubricate and maintain values and upper cylinders better than tetraethyllead and save fuel also.

EXAMPLE 2

This Example illustrates the use of the fuel conditioner of the present invention in a fleet of 135 trucks designed for leaded gasoline but using no-lead gasoline with FC-I. The purpose was to see if failures in the valve train area due to the poor lubricating properties of no-lead gasoline can be obviated and if an "octane requirement increase" due to the use of lower octane level no-lead gasoline can be forestalled without using tetraethyllead as an additive.

The 135 trucks ranged in model year from new to 12 years old. They were International Harvester, General Motors, Ford, and FWD with gross weights from 20,000 to 30,000 lbs. At the beginning of the test their odometer readings averaged 35,000 miles. The test lasted 11,000 miles with 1 part per thousand FC-I employed in the fuel.

During the test these heavy duty gasoline trucks designed for leaded gasoline (31 12,000–13,000 lbs.; 73 13,000–32,000 lbs.; 27 7,000 lbs.) ran up to 43,000 miles (average 11,000 miles) on 87 octane unleaded gasoline, rather than on 89 octane leaded gasoline without increasing upper cylinder failures.

In a control test (SAE paper 710367) it was reported that new engines designed for leaded gasoline but running on unleaded fuel have valve seat failures as early as 5,000 miles and normally by 11,000 miles.

COMPARATIVE EXAMPLE 1

This Comparative Example illustrates the results obtained in service in running three fleets of heavy duty trucks fueled by unleaded gasoline without employing the fuel conditioner of the present invention.

Fleet A comprised 34 heavy duty service trucks manufactured by International Harvester, Ford, and General Motors between 1970 and 1984. Before this Example period, they had been run in normal line service for a utility on leaded gasoline. After running the vehicles on plain, unleaded gasoline, the drivers complained of poor engine performance, engine problems developed, especially with the valve train and valve seats; the octane requirement increased, so unleaded premium fuel had to be used. Within six months, the fleet had to be returned to the use of leaded fuel.

Fleet B comprised 25 heavy duty service trucks of the same manufacturers' as Fleet A, made between 1972 and 1984. Within two months of starting to use unleaded gasoline without any fuel conditioner, these trucks experienced valve seat problems, piston failures, and driveability problems. The fleet owner was forced by this poor performance to switch back to the use of leaded gasoline.

Fleet C comprised 25 trucks of gross weight between 20,000 and 30,000 lbs., made by the same three manufacturers as Fleets A and B. After switching from leaded to unleaded gasoline, severe valve seat failures were experienced in the IHC trucks, followed by the Ford and GMC trucks. Replacement heads with new seat inserts from the original manufacturers were installed, which eased but did not solve the problem. After many complaints from the drivers, this utility switched back to the use of leaded gasoline.

EXAMPLE 3

This Example illustrates the benefits of the fuel conditioner of the present invention when tested in a university laboratory test stand.

A 1967 six-cylinder 200 cubic inch Ford engine with less than 1,000 hours use was coupled to a General Electric Co. dynamometer. The ignition timing was set at 6° before top center, the spark plugs clean, and the fuel-air ratio was set to give 0.5% carbon monoxide at idle. A Beckman model 590 exhaust analyzer was used to measure hydrocarbon and carbon monoxide levels.

The engine oil was new Texaco Havoline 20-20W with a new filter. Gulf 89 octane gasoline was the fuel.

The engine ran at 2200 rpm, equivalent to 55 mph. Values of torque were calculated so that 20, 40, 60, 80, and 100% load could be simulated.

Table II shows the testing regime and the results for control runs made with no fuel conditioner. As the repeatability of fuel usage was excellent, it was decided to use runs 5, 6, and 7 which were at 60% load conditions to evaluate the fuel conditioner additive in the test engine.

TABLE II

CONTROL RUNS WITHOUT FC-I
N = 2200 RPM

| Run | Temp.(°F.) | | Torque | | Run Time | | Fuel used | Fuel Rate | Emissions | |
|---|---|---|---|---|---|---|---|---|---|---|
| | | | | | | | | | HC | CO |
| No. | Oil | Water | Tare | Run'g. | (min) | (sec) | (lbs) | (lbs/min) | (ppm) | (%) |
| 1 | 165 | 160 | 3.5 | 125.6 | 3 | 0 | 1.324 | .441 | 132 | 2.3 |
| 2 | 170 | 162 | 3.5 | 125.6 | 3 | 0 | 1.326 | .442 | 120 | 2.45 |
| 3 | 170 | 162 | 3.5 | 101.0 | 4 | 0 | 1.392 | .348 | 12 | .18 |
| 4 | 175 | 162 | 3.5 | 101.0 | 4 | 0 | 1.391 | .348 | 12 | .18 |
| 5 | 170 | 162 | 3.5 | 76.5 | 4 | 0 | 1.176 | .294 | 0 | .17 |
| 6 | 170 | 162 | 3.5 | 76.5 | 4 | 0 | 1.177 | .294 | 0 | .17 |
| 7 | 170 | 162 | 3.5 | 76.5 | 4 | 0 | 1.181 | .295 | 0 | .17 |
| 8 | 170 | 162 | 3.5 | 52.5 | 4 | 0 | .870 | .218 | 0 | .18 |
| 9 | 170 | 162 | 3.5 | 52.5 | 4 | 0 | .865 | .216 | 0 | .18 |
| 10 | 170 | 162 | 3.5 | 52.5 | 4 | 0 | .855 | .214 | 0 | .18 |
| 11 | 170 | 162 | 3.5 | 27.8 | 5 | 0 | .800 | .160 | 5 | .17 |
| 12 | 170 | 162 | 3.5 | 27.8 | 5 | 0 | .796 | .159 | 7 | .17 |

TABLE II-continued

| CONTROL RUNS WITHOUT FC-I N = 2200 RPM | | | | | | | | | | |
|---|---|---|---|---|---|---|---|---|---|---|
| Run | Temp.(°F.) | | Torque | | Run Time | | Fuel used | Fuel Rate | Emissions | |
| No. | Oil | Water | Tare | Run'g. | (min) | (sec) | (lbs) | (lbs/min) | HC (ppm) | CO (%) |
| 13 | 170 | 162 | 3.5 | 27.8 | 5 | 0 | .800 | .160 | 5 | .17 |

It was found that under the control conditions the average fuel consumption in runs 5, 6 and 7 was 0.2943 lbs/min. When 1 part per thousand of the FC-I of Example I was employed in the same series of tests at 60% load conditions (19 ml. or 0.64 fl. oz. per 5 ga.), the average fuel consumption dropped to 0.288 lbs/min, a saving of 2.14 percent.

EXAMPLE 4

This Example illustrates the ability of the fuel conditioner of the present invention to lower the production of unburned hydrocarbon and carbon monoxide, when employed in automobile engines.

Table III shows the results on six automobile engines of the use of 1 part per thousand FC-1, as in Example 1, when run for the number of miles shown.

TABLE III

| EXHAUST EMISSION TESTS | | |
|---|---|---|
| Vehicle | Miles Run | % Reduced Emissions |
| 1. 1980 Oldsmobile Ninety-Eight | 1500 | HC 16%<br>CO 51% |
| 2. 1978 Pontiac Grand Prix | 1500 | HC 79%<br>CO 15.78% |
| 3. 1980 Cadillac deVille | 321 | HC 61%<br>CO 16% |
| 4. 1975 Fiat with 4 cylinder engine | 208 | HC 100%<br>CO 21% |
| 5. 1971 Ford Pinto with 4 cylinder engine | 227 | HC 89%<br>CO 27% |
| 6. 1980 Pontiac Sunbird with 4 cylinder engine | 380 | HC 91%<br>CO 33% |
| | Average | HC 72%<br>CO 27% |

HC = unburned hydrocarbon
CO = carbon monoxide

EXAMPLE 5

This Example illustrates the decrease in fuel consumption of a diesel truck employing the fuel conditioner of the present invention during the winter months, when fuel consumption would be expected to increase.

A ten-ton diesel truck (20 tons full) was equipped with an accurate flow meter to read gph fuel consumption during its regular service route. The test was run from October 1 to January 31. During the warmer months of October and November control data were obtained without the use of the fuel conditioner. During the colder months of December and January FC-II, as in Example 1, was employed in the gasoline at a level of 1 part per thousand. Table IV summarizes the results.

TABLE IV

| Improvement in Fuel Economy in Cold Weather | | | | | |
|---|---|---|---|---|---|
| | | | Fuel Usage gph | | |
| | Month | Temp. °F. | early | late | Total Hours |
| No FC-II | Oct. | 62.5 | 1.475/ | 1.568 | 316 |
| | Nov. | 46.4 | 1.557/ | 1.642 | av. 1.504 |

TABLE IV-continued

| Improvement in Fuel Economy in Cold Weather | | | | | |
|---|---|---|---|---|---|
| | | | Fuel Usage gph | | |
| | Month | Temp. °F. | early | late | Total Hours |
| With FC-II | Dec. | 43.3 | 1.455/ | 1.487 | 210 |
| | Jan. | 28.4 | 1.449/ | 1.43 | av. 1.44 |

Even with decreased temperature, it is seen that fuel consumption has been decreased 4.2 percent. When normalized for the expected 15% increase in fuel requirement due to colder weather, the saving is seen to be about 19%.

EXAMPLE 6

This Example illustrates the reduction in fuel consumption experienced by testing a wide variety of gasoline powered automobiles, vans, trucks, and diesel truck engines with the fuel conditioner of the present invention.

A Fluidyne model 1214D/1228 fuel flow rate transducer was employed to measure the flow rate, temperature, and total weght of fuel burnt for the diesel engine tests. Similar Fluidyne equipment was employed for gasoline engines.

Thirty-eight vehicles were tested with mileage measured for a standard amount of unleaded fuel. Then FC-I fuel conditioner was added at 1 part per thousand for the gasoline engines, as in Example I, and FC-II was added at 1 part per thousand for the diesel engines.

Of the 34 gasoline engines tested, 30 showed increased mileage ranging from 0.8% to 12.8%. The four diesel engines all showed mileage gains ranging from 5.9% to 15.5%. Two gasoline trucks, one van, and one automobile showed mileage losses ranging from −0.012% to −0.4%.

All 38 engines showed an average mileage gain of 5.33%.

EXAMPLE 7

This Example illustrates the application of the present invention to diesel railroad engines.

Two railroad diesel engines were operated concurrently for 30 days hauling the same load, one with FC-II, and the other is a control without any fuel conditioner. The control engine burned 4,200 gallons of fuel during the 30 days. It was found that the diesel engine employing the fuel conditioner used 5% less fuel than the control engine, using a total of 4,000 gallons of fuel during the month. Furthermore, visual inspection showed that the diesel engine with the fuel conditioner burned much cleaner than the control engine, leading to more power, less friction, and longer component life.

EXAMPLE 8

This Example illustrates the application of the present invention to stationary diesel engines.

Three engines were tested: an inline Detroit diesel, model G-71; a Cummings model 230; and a General Motors, model 71, V-12.

Each dynomometer test was run for 30 minutes at 200 hp recording all readings of hp output, rpm, and fuel usage. Then FC-II, as in Example 1, was added and the dynomometer test run for 40 minutes.

Fuel consumption per minute at 200 hp, as measured by Fluidyne flow meter 1214D/1228 with 241-200 or 285-210 transducers were decreased as follows:

| | % Decrease in Fuel |
|---|---|
| G-71 Detroit | 10.2 |
| Cummings 230 | 12.8 |
| V-12 GM 71 | 3.7 |
| Average | 8.9 |

EXAMPLE 9

This Example illustrates the use of the present invention to enable the driver to run motorcycles on unleaded gasoline.

A municipal police department dedicated six model FLH 1978 Harley-Davidson motorcycles used for normal police duties for a period of seven months. Each motorcycle accumulated about 3,500 miles during this test.

Of the six model FLH 1978 H-D motorcycles, four were selected to have new heads installed at the start of the test. The heads on two of the engines were left as is. Three of the cycles (two with new heads) were tested for seven months using straight 87 octane, unleaded gasoline. Three of the cycles (two with new heads) were tested for seven months using 87 octane, unleaded gasoline containing 1 part per thousand FC-I, as in Example 1. At the beginning of the seven-month, 3,500-mile test, the following parameters were checked on all six motorcycles: ignition timing, spark plug gaps, air-to-fuel ratio, condition of cam shaft, compression test, and overall condition of the engine.

At the end of the seven-month test, the following observations were made:

(a) There was no wear on the new heads using FC-I, while there was measurable wear on the valve stems and valve seats of the new heads run on unleaded gasoline without FC-I.

(b) The deposits in the three engines run on fuel containing FC-I were smaller in volume, less carbonaceous, less hard, and less abrasive than the combustion chamber deposits of the three motorcycles using straight, unleaded gasoline during the test.

(c) The officers driving the motorcycles using fuel containing FC-I reported no stalling when decelerating, no "knocking" or "pinging" from pre-ignition at low speeds, no need for new spark plugs during the test, and good "driveability" throughout. The officers driving the motorcycles with plain unleaded, 87 octane fuel reported stalling on start-up, sluggish operation with coughing and sputtering, poor top end performance due to pre-ignition, lugging and needed spark plug changes.

The Harley-Davidson engineers monitoring the tests and supervising the tear-down and evaluation of the engines at the end of the test reported much better control and fewer carbonaceous deposits when fuel conditioner of the present invention was employed.

EXAMPLE 10

This Example illustrates the use of the fuel conditioner of the present invention in four-cycle marine engines in a stationary test to reduce valve seat wear.

The accelerated wear test was carried out on six new, 350-cubic inch Chevrolet V-8 marine engines equipped with Stellite valves and induction-hardened valve seats. One set of three engines was run at 4,600 rpm and a 8.5 to 1 compression ratio to simulate normal performance. Another set of three engines was run at 5,200 rpm at 9.0 to 1 compression ratio to simulate high performance. Three fuels were employed in each set of engines: standard leaded fuel, unleaded fuel and unleaded fuel containing 1 part per 1850 FC-I, as in Example 1, the fuel conditioner of the present invention.

The test cycle for each inboard marine engine was as follows: (a) run engine under load for 55 minutes; and (b) bring engine down to idle for five minutes, to check function. Every 50 hours the engine was shut down to measure valve seat recession. The criterion for successful performance was 500 hours of test operation without significant valve seat wear.

The results in this test were as follows:

Normal Operation at 4,600 rpm and 8.5 compression:

| | |
|---|---|
| Leaded gasoline | 500 hours |
| Unleaded gasoline | 150–200 hours |
| Unleaded gasoline with FC-I | 500 hours |

High Performance Operation at 5,200 rpm and 9.0 compression:

| | |
|---|---|
| Leaded gasoline | 500 hours |
| Unleaded gasoline | 50–70 hours |
| Unleaded gasoline with FC-I | 500 hours |

EXAMPLE 11

This Example illustrates the use of the fuel conditioner of the present invention in a 300° F. accelerated fuel oil stability and color test. The test is employed to evaluate fuel oils in air, for short times, at high temperature for typical service in diesel railroad engines. The criteria are the amount of insoluble residue formed and the change in color in fuel oils held for 90 minutes at 300° in the presence of air.

This test is variously called the EMD Diesel Fuel Stability Test, the Union Pacific Diesel Blotter Test, Santa Fe Blotter Test, Nalco 300° F. Test, and DuPont Petroleum Laboratory Test F21-61.

Fifty ml. samples of fuels are filtered through No. 1 Whatman filter paper, measured for color by ASTM color test D1500, aged at 300° F.±5° F. for 90 minutes in an oil bath, cooled to room temperature, filtered again, measured for color again, all under standard conditions and compared to standard amounts of residue and change in color.

An "Easicult Combi" (Kit 37304-2, Orion Diagnostica Co., Espoo, Finland) for microorganisms in the fuel was also carried out.

Astoria kerosene (Sample T-5504) and Astoria #2 oil (Sample T-5505) were subjected to the tests described above both with and without 1 part per 2,000 parts fuel of a fuel conditioner containing 40 parts polar oxyginated hydrocarbon (Alox 400L), 20 parts hexanol, 30 parts ethylene glycol n-butyl ether and 10 parts diethylene glycol monomethyl ether, with the following results:

| | Stability | | Color Stability | | Microorganisms | |
|---|---|---|---|---|---|---|
| | With Cond. | Without Cond. | With Cond. | Without Cond. | With Cond. | Without Cond. |
| Kerosene | 3 | 9 | 0.5/1.5 | 0.5/5.0 | Neg. | Pos. |
| #2 Oil | 2 | 16 | 4.0/4.5 | 4.0/8.5 | Neg. | Pos. |

Having illustrated the invention by the Examples above, the scope of protection to be granted by Letters Patent is more fully described in the following claims.

We claim:

1. A fuel conditioner comprising 10 to 80% of a polar oxygenated hydrocarbon having an average molecular weight from about 250 to about 500, an acid acid number from about 25 to about 125, and a saponification number from about 30 to about 250; and 5 to 50% of an oxygenated compatibilizing agent having a solubility parameter of from about 8.8 to about 11.5 and moderate to strong hydrogen-bonding capacity.

2. A fuel conditioner as in claim 1, wherein the acid number is from about 50 to about 100.

3. A fuel conditioner as in claim 1, further comprising from 5 to 75% of a hydrophilic separant for combining any water present into a discrete layer.

4. A fuel conditioner as in claim 1, wherein the oxygenated compatibilizing agent is an alcohol containing more than three carbon atoms.

5. A fuel condition as in claim 4, wherein the alcohol is a hexanol.

6. A fuel conditioner as in claim 4, wherein the alcohol is a decanol.

7. A furl conditioner as in claim 4, wherein the alcohol is a dodecanol.

8. A fuel conditioner as in claim 3, wherein the hydrophilic separant is a glycol monoether.

9. A fuel conditioner as in claim 8, wherein the glycol monoether is diethylene glycol monomethyl ether.

10. A fuel conditioner as in claim 3, wherein the oxygenated hydrocarbon is present in an amount from about 20 to about 40 weight percent, the oxygenated compatibilizing agent is present in an amount of from about 10 percent by weight to about 40 percent by weight, and the hydrophilic separant is present in an amount of from about 10 percent by weight to about 50 percent by weight.

11. A fuel conditioner as in claim 1, further comprising an aromatic hydrocarbon.

12. A fuel conditioner as in claim 11, wherein the aromatic hydrocarbon is xylene or a xylene.

13. A fuel conditioner as in claim 1, further comprising a hydrocarbon base stock.

14. A fuel conditioner as in claim 13, wherein the hydrocarbon base stock is mineral oil.

15. In combination, (a) a gasoline for internal combustion engines, and (b) a fuel conditioner comprising a polar oxygenated hydrocarbon having an average molecular weight from about 250 to about 500, an acid number from about 25 to about 125, a saponification number from about 30 to about 250; an oxygenated compatibilizing agent with a solubility parameter from about 8.8 to about 11.5 and moderate to strong hydrogen-bonding capacity; a compound selected from the group consisting of an aromatic hydrocarbon, a base stock oil, or a mineral oil; and a separant for combining any water present into a discrete layer, wherein the fuel conditioner is added in an amount effective to achieve efficient combustion.

16. The combination of claim 15, wherein the separant is a glycol monoether.

17. In combination, (a) a fuel oil for furnaces or diesel engines, and (b) a fuel conditioner comprising a polar oxygenated hydrocarbon having an average molecular weight from about 250 to about 500, an acid number from about 25 to about 125, a saponification number from about 30 to about 250; an oxygenated compatibilizing agent with a solubility parameter from about 8.8 to about 11.5 and moderate to strong hydrogen-bonding capacity; an aromatic hydrocarbon; and a base stock or mineral oil, wherein the fuel conditioner is added in an amount effective to achieve efficient combustion.

18. The combination of claim 17, wherein the compatibilizing agent is an alcohol with more than three carbon atoms and the aromatic hydrocarbon is xylene.

19. In combination, (a) a fuel selected from the group consisting of a heating oil and a hydrocarbon/alcohol blend wherein the alcohol has one to three carbon atoms and is present from 5 to 90 weight % of the blend; and (b) a fuel conditioner comprising a polar oxygenated hydrocarbon having an average molecular weight from about 250 to about 500, an acid number from about 25 to about 125, a saponification number from about 30 to about 250; an oxygenated compatibilizing agent with a solubility parameter from about 8.8 to about 11.5 and moderate to strong hydrogen-bonding capacity; and an aromatic hydrocarbon wherein the fuel conditioner is added in an amount effective to achieve efficient combustion.

20. The combination of claim 19, wherein the compatibilizing agent is an alcohol with more than three carbon atoms, and the aromatic hydrocarbon is xylene.

21. In combination, (a) an aviation fuel, and (b) a fuel conditioner comprising a polar oxygenated hydrocarbon having an average molecular weight from about 250 to about 500, an acid number from about 25 to about 125, a saponification number from about 30 to about 250; an oxygenated compatibilizing agent with a solubility parameter from about 8.8 to about 11.5 and moderate to strong hydrogen-bonding capacity; and a separant for combining any water present into a discrete layer, wherein the fuel conditioner is added in an amount effective to achieve efficient combustion.

22. The combination of claim 21, wherein the separant is a glycol monoether.

23. The combination of any of claims 15, 16, 17, 18, 19, 20, 21, or 22, wherein the fuel conditioner is present in an amount from about one part per 500 parts of fuel to about one part per 2,000 parts of fuel.

24. The combination of any of claims 15, 16, 17, 18, 19, 20, 21, and 22, wherein the fuel conditioner is present in an amount from about one part per 800 parts of fuel to about one part per 1,200 parts of fuel.

25. A fuel conditioner comprising (a) 10 to 80% of a polar oxygenated hydrocarbon having an average molecular weight from about 250 to about 500, an acid number from about 25 to about 125, and a saponification number from about 30 to about 250;

(b) 5 to 50% of an oxygenated compatibilizing agent having a solubility parameter of from about 8.8 to about 11.5 and moderate to strong hydrogen-bonding capacity; and (c) one or more materials selected from the group consisting of separating agents, aromatic hydrocarbons, and hydrocarbon base stocks.

* * * * *